United States Patent [19]

Schifman

[11] 3,946,939

[45] Mar. 30, 1976

[54] MAILBOX

[75] Inventor: Edward J. Schifman, Nashville, Tenn.

[73] Assignee: Aladdin Industries, Inc., Chicago, Ill.

[22] Filed: Apr. 15, 1974

[21] Appl. No.: 461,103

[52] U.S. Cl. ..... 232/17; 232/45

[51] Int. Cl.[2] ..... A47G 29/12

[58] Field of Search ..... 232/17, 38, 45, 35; 292/31; 312/286, 284, 283

[56] References Cited

UNITED STATES PATENTS

| | | | |
|---|---|---|---|
| 426,928 | 4/1890 | Elwell | 232/45 X |
| 669,464 | 3/1901 | Lidke | 232/45 |
| 736,815 | 8/1903 | Brown | 232/17 |
| 739,581 | 9/1903 | Bragunier | 312/286 X |
| 753,163 | 2/1904 | Robison | 232/35 |
| 1,839,834 | 1/1932 | Coleman | 232/45 X |
| 2,561,007 | 7/1951 | Bierig | 232/17 |
| 3,093,302 | 6/1963 | Alley | 232/35 |

FOREIGN PATENTS OR APPLICATIONS

| | | | |
|---|---|---|---|
| 171,196 | 11/1934 | Switzerland | 312/286 |

*Primary Examiner*—Francis K. Zugel

*Attorney, Agent, or Firm*—McDougall, Hersh & Scott

[57] ABSTRACT

A mailbox having a platform for receiving mail and a cover for providing weather protection is disclosed. The cover is pivotably mounted to the center of the platform and may be opened by a latch on either side thereof. When either latch is opened, the cover rotates to provide access to the platform, and the latch on the opposite side drops free of the platform.

9 Claims, 3 Drawing Figures

MAILBOX

BACKGROUND OF THE INVENTION

This invention relates to the field of mailbox enclosures. More specifically, it relates to mail receiving devices for rural routes, suburban homes, and other applications where a postman does not deliver the mail to the recipient's front door. Prior mailboxes of this type have included designs such as the familiar covered tunnel design which has a bottom hinged end flap which is opened for insertion and removal of mail.

An improvement design of the covered tunnel mailbox is disclosed in U.S. Pat. Nos. 3,106,335 and 3,680,773 wherein a hinged end flap is provided on both sides of the covered tunnel mailbox thereby permitting the postman to deliver mail from the street side and the recipient to remove mail from the side of the mailbox away from automobile traffic. A drawback in covered tunnel mailboxes is that these boxes open from the top and there is a tendency for rain, etc. to enter the box, thereby to wet mail deposited therein.

A second type of mailbox employs a platform having a cover hinged at one end thereof such that when a mailman delivers mail he lifts the cover and places the mail onto the platform. To remove the mail the recipient performs the same steps from the street side, as illustrated in U.S. Pat. No. 1,204,494. This design does provide improved weather resistance but does not have the safety capability of the double entry tunnel box.

It is accordingly an object of the present invention to provide a weather resistant mailbox which permits the insertion of mail from the street side and the removal thereof from the other side of the box.

It is a further object of the present invention to provide a mailbox which provides a completely closed covering to prevent rain and the like from getting into the mailbox.

It is a further object of the present invention to provide a mailbox which employs a latch releasing mechanism which positively latches the mailbox in a closed position and which will, when unlatched, permit the cover to drop to either side of the mailbox for insertion or removal of mail.

Other objects and advantages of the present invention will become apparent from the remaining portion of the specification.

DETAILED DESCRIPTION

Figure 1:
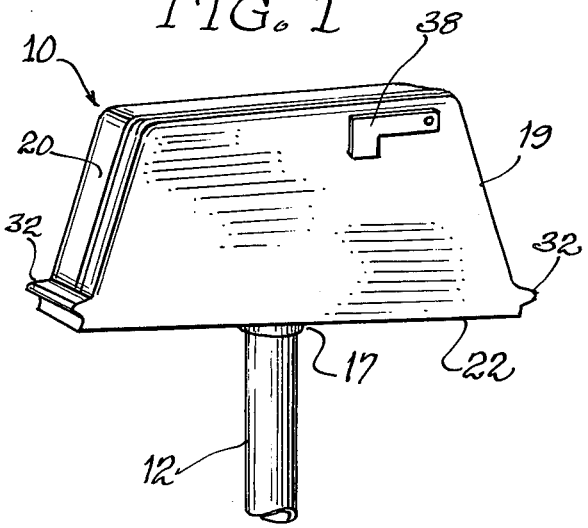
FIG. 1 is a perspective view of a mailbox according to the present invention in a closed position.
Figure 2:
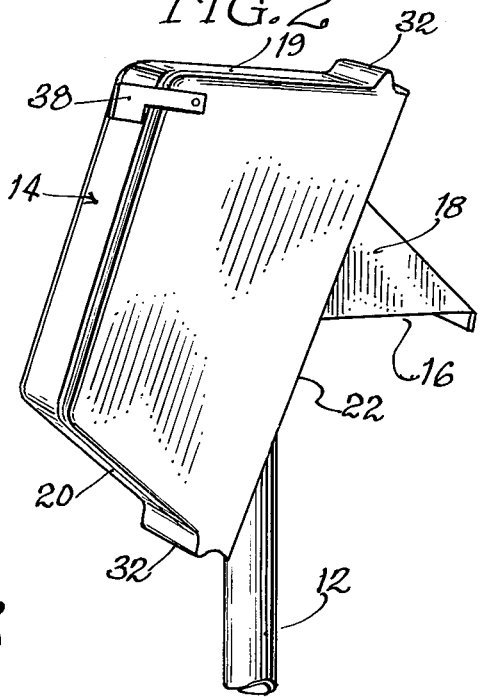
FIG. 2 is a perspective view of the mailbox of FIG. 1 in an open position for receiving mail therein.
Figure 3:
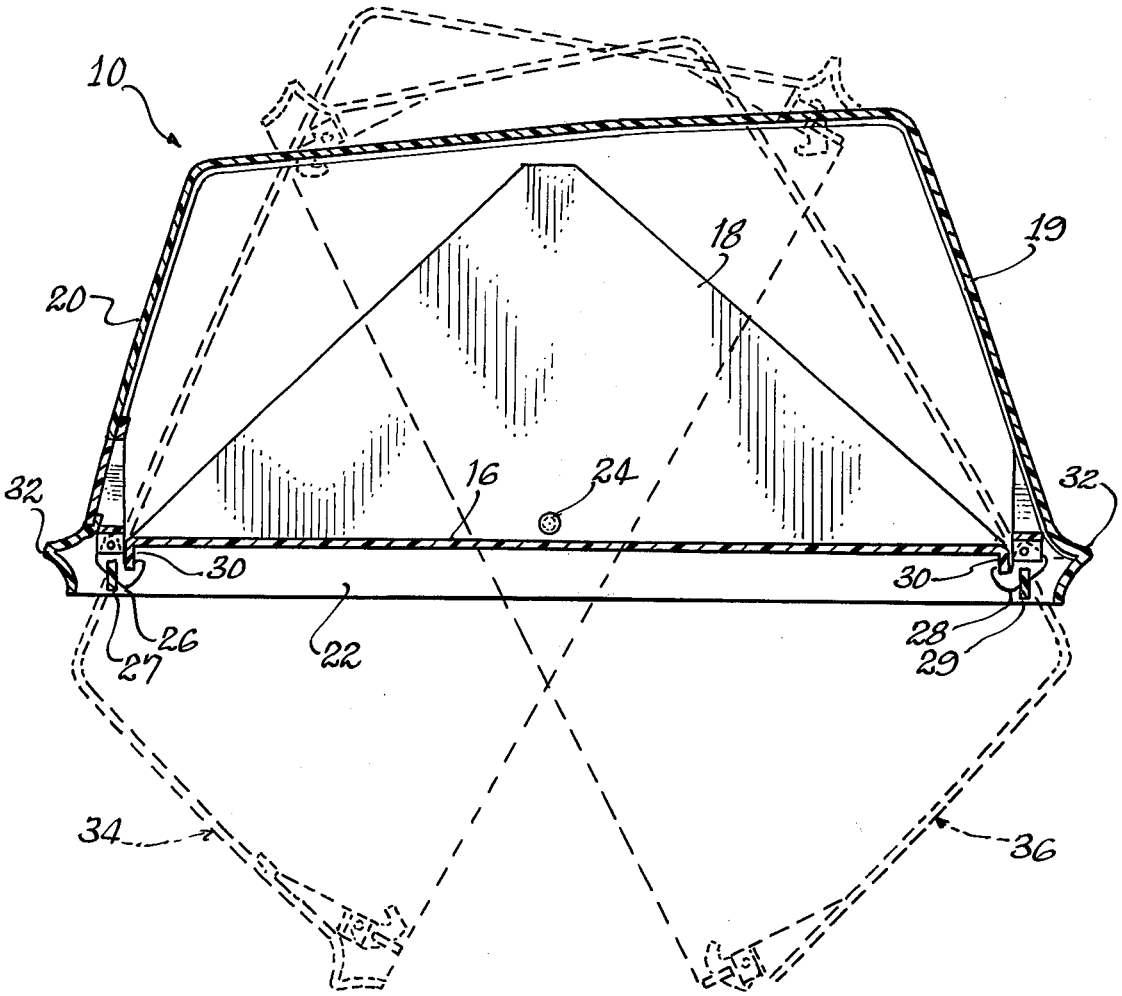
FIG. 3 is a front cross-sectional view of the mailbox illustrating the details of the latch means and showing the front and rear opening positions in dashed lines.

Referring to the drawings, a mailbox 10, according to the present invention, may be mounted to a post 12 or other suitable mounting such as a fence or brick stand, as desired. As shown in FIGS. 2 and 3, the box 10 has a cover 14 and a mail receiving platform 16. The platform 16 is horizontally disposed and adapted to support pieces of mail such as letters. magazines, postcards and the like, thereon. To enhance the ability of the platform to retain mail, it can be provided with triangular sides 18 rising vertically therefrom. The underside of the platform 16 is provided with a post receptacle 17 for mounting on the post 12 or holes for mounting.

The cover 14 is generally rectangular in cross section, although if desired, one side 19 may extend above the opposite side 20 to facilitate loading of the box from a mail delivery vehicle. The cover 14 is closed on five sides, being open only along its bottom 22. The cover is pivotally mounted to the platform 16 by pins 24, journaled through the triangular sides 18. Pins 24 are horizontally disposed and located centrally of the platform 16. The cover is adapted to rotate about the pins 24 relative to the platform 16 as indicated by the dashed lines in FIG. 3. The cover automatically stops when it comes in contact with the platform.

Mounted on the inside of the cover 14 near the bottom end of sides 19 and 20 are latch means 26 and 28. Each latch means is provided with a release tab 27 and 29 respectively and is adapted to engage a tab 30 extending downwardly from the platform 16. As shown in FIG. 3, the cover has a V-shaped portion 32 in each side to permit opening and closing of the latch means.

When both latch means engage the tabs 30 on the platform, the cover 14 is maintained in a closed position covering the top and all four sides of the platform thereby to protect the mailbox contents from rain, wind and the like. To load the mailbox, a mail carrier drives or walks to the box which is positioned so that the side 19 is facing the street. He then manually retracts the latch means 28 by grasping tap 29 and pulling the latch means into the V-shaped area 32 until it clears the tab 30. The cover is then rotated counterclockwise, as shown in FIG. 3, to the position indicated by dashed lines 34. The rotation of the cover to this position is accomplished due to the arrangement of the latch means such that the latch 26, although not manually released, nevertheless drops free of the tab 30.

After a mail carrier has placed the mail into the mailbox he returns the cover to its initial position by reversing the above procedure. The cover is rotated back to its horizontal position, and as will be explained, the latch means 26 and 28 again engage the tabs 30, locking the cover into its closed position.

The latching means 26 and 28 may be two-position latches, that is, a latch having a closed position as shown in FIG. 3 and an open position retracted into the V-shaped area 32; or preferably, the latch means may be spring loaded latches or formed of spring steel material such that they are resiliently biased to the position shown in FIG. 3. In the latter two cases, when the cover is rotated from either open position towards the closed position, the latch which was manually released will cam over the end of the platform due to its rounded end and then snap over the tab 30. The other latch which has dropped away from the platform will likewise return to the locked position engaging the tab 30.

In order for a postal patron to receive mail, the procedure described for the postal carrier is duplicated but from the opposite side of the box. This is desirable so that danger to the postal patron from traffic where the box is mounted along a street is avoided. In this manner the patron can remove mail from the side opposite the street in a safe manner. To remove mail the patron retracts the latch means 26 by pushing back on the tab 27 until the latch means clears the platform tab 30. The cover may then be rotated to the position indicated by the dashed lines 36 in FIG. 3 for removing mail. As before, to return the cover to its closed position, the procedure is just reversed and the spring loaded latch 26 will reengage the tab 30 to lock the cover in its closed position.

While the mailbox may be constructed of many materials, including those previously used for mailbox construction such as metals, it is preferred that the product be formed of plastic, such as an ABS plastic, so that it is relatively impervious to dents and weather without the necessity for continual treatment and painting.

As shown in FIG. 2, the box may be provided with an optional carrier alert flag 38 as is conventional on rural type mailboxes. The flag is mounted to the front of the cover and attached by a hinge pin. When the cover is rotated, the flag falls out of position, resetting it for future use, and indicating to the patron that the postman has picked up any mail which has been left in the box.

While I have shown and described embodiments of this invention in some detail, it will be understood that this description and illustrations are offered merely by way of example, and that the invention is to be limited in scope only by the appended claims.

I claim:

1. A weather protected mailbox which may be opened from either of two ends comprising:

a. a rectangular platform having a front and rear end and a pair of upright side members for receiving mail thereon;

b. a cover pivotally mounted to said upright side members completely enclosing said platform; and c. front and rear latch means provided on said cover to engage said front and rear ends of said platform for securing said cover in the enclosing position, said latch means engaging the underside of said platform to prevent upward movement of each end of said cover while permitting downward movement thereof, whereby said cover is movable to permit access to either end of the platform by operation of one of said latch means.

2. The mailbox according to claim 1 wherein said latch means are arranged such that manually releasing either permits the cover to pivot to one of said open positions the other latch means simultaneously and without manual release disengaging from the platform.

3. The mailbox according to claim 1 wherein said platform and cover are plastic.

4. The mailbox according to claim 1 wherein said latch means comprise spring loaded latches.

5. The mailbox according to claim 1 wherein said latch means comprise latches resiliently biased to a position for locking said cover in said closed position.

6. The mailbox according to claim 2 wherein both of said latch means have a surface thereon adapted to cam against said platform such that during closing of said cover the latch means which was manually released to open the box will reengage said platform.

7. The mailbox according to claim 2 wherein said latch means engage vertically downwardly extending tabs on said platform.

8. The mailbox according to claim 1 wherein said cover is rectangular in cross section and closed on all sides except its bottom.

9. The mailbox according to claim 1 wherein said cover is pivotally mounted near the center of the platform on a pair of pins journaled into said side members.

* * * * *